US005917521A

United States Patent [19]

Haga et al.

[11] Patent Number: 5,917,521

[45] **Date of Patent: *Jun. 29, 1999**

[54] INK JET RECORDING APPARATUS AND METHOD FOR JETTING AN INK DROPLET FROM A FREE SURFACE OF AN INK MATERIAL USING VIBRATIONAL ENERGY

[75] Inventors: Koichi Haga; Yoshiyuki Shiratsuki; Ichirou Asai; Keizo Abe; Yasufumi Suwabe; Shinobu Ozeki, all of Nakai-machi, Japan

[73] Assignee: Fuji Xerox Co.,Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/803,859

[22] Filed: Feb. 21, 1997

[30] Foreign Application Priority Data

Feb. 26, 1996 [JP] Japan ..... 8-038562
Jul. 23, 1996 [JP] Japan ..... 8-193286

[51] Int. Cl.[6] ..... B41J 2/135

[52] U.S. Cl. ..... 347/46; 347/68

[58] Field of Search ..... 347/46, 40, 44, 347/47, 68

[56] References Cited

U.S. PATENT DOCUMENTS

| | | | |
|---|---|---|---|
| 4,605,167 | 8/1986 | Maehara | 347/1 X |
| 5,339,101 | 8/1994 | Rawson et al. | 347/46 |
| 5,589,864 | 12/1996 | Hadimioglu | 347/46 |
| 5,612,723 | 3/1997 | Shimura et al. | 347/46 |

FOREIGN PATENT DOCUMENTS

| | | | |
|---|---|---|---|
| A-54-10731 | 1/1979 | Japan . | |
| A-62-66943 | 3/1987 | Japan . | |
| A-62-251153 | 10/1987 | Japan . | |
| A-62-264962 | 11/1987 | Japan . | |
| 2-55139 | 2/1990 | Japan | 347/46 |
| A-2-172748 | 7/1990 | Japan . | |
| A-2-178056 | 7/1990 | Japan . | |
| A-2-269058 | 11/1990 | Japan . | |
| 4-294147 | 10/1992 | Japan | 347/46 |

*Primary Examiner*—Benjamin R. Fuller
*Assistant Examiner*—C. Dickens
*Attorney, Agent, or Firm*—Oliff & Berridge, PLC

[57] ABSTRACT

An ink jet recording device for jetting an ink droplet from a free surface of an ink material includes: an ink container for containing the ink material and providing the free surface of the ink material therein; a vibrating member for providing a vibrating energy to the free surface of the ink material by contacting thereto at an interface portion between the free surface of the ink material and the ink container, wherein the vibrating means surrounds the free surface so that the vibrating energy is concentrated at one specific portion on the free surface of the ink material in order to jet the ink droplet therefrom; and an actuating system for actuating the vibrating member. An ink jet recording method using the same is also disclosed.

18 Claims, 7 Drawing Sheets

INK JET RECORDING APPARATUS AND METHOD FOR JETTING AN INK DROPLET FROM A FREE SURFACE OF AN INK MATERIAL USING VIBRATIONAL ENERGY

BACKGROUND OF THE INVENTION

This invention generally relates to an ink jet recording method and an ink jet apparatus using the same. More specifically, this invention relates to an ink jet recording method utilizing vibration energy and an ink jet apparatus using the same.

On-demand type ink jet recording methods for jetting ink droplets on-demand from nozzles are well known. Recently, those ink jet recording methods are typically classified as piezoelectric-type or thermal-type. In the piezoelectric-type ink jet method, a pulse voltage is applied to a piezoelectric element that is located in an ink reservoir in order to deform the shape of the piezoelectric element for changing internal ink pressure thereof so that an ink droplet is jetted from a nozzle and a dot image is reproduced on a recording sheet. In thermal-type ink jet method, ink is heated by a heating element that is located in an ink reservoir for forming a bubble so that an ink droplet is jetted from a nozzle by the pressure of the generated bubble and a dot image is reproduced on a recording sheet.

In such ink jet recording techniques, resolution of reproduced dot images have typically been limited up to 300 dot per inch (dpi); however, recently, demands for increasing the image resolution up to 600 dpi, 720 dpi or more have been increased.

To comply with such demands and to perform such high-resolution recording, dot diameter to be recorded on a recording sheet should be decreased in accordance with such required resolution. In those aforementioned methods, nozzle diameter may be decreased in order to decrease the dot diameter. However, if the nozzle diameter is once decreased, nozzle clogging due to foreign matter or coagulation of ink material on an ink jetting surface or changing of ink jetting direction due to adherence of residue of the ink around the nozzle tend to occur. Therefore, there is an issue that such required nozzle diameter necessary to record a dot having a diameter corresponding to such resolution can not be utilized because the aforementioned nozzle or image defects occur.

Regardless of such proposals, recently, an ink jet recording method utilizing a surface acoustic wave has also been proposed. For example, an ink jet recording method for forming a surface acoustic wave by interdigital electrodes that are located in an ink reservoir and then vibrating the ink with a leaked Raley wave generated therefrom to jet the ink from a slit or nozzle is disclosed in Japanese unexamined patent publication (JP-A) 54-10731. Another ink jet recording method is also proposed in JP-A 62-66943, which comprises placing a concentrically-formed interdigital electrode at a bottom portion of the ink reservoir, forming leaked Raley waves and concentrating the waves conically and placing ink material so that the top of the cone is located near the surface of the ink material in order to concentrate the vibrating energy propagated in the ink at the ink surface and jet an ink droplet from the ink surface.

In those methods, since the diameter of the produced ink droplet is not directly affected by the nozzle diameter, it is not necessary to reduce the nozzle diameter as well as its shape independency. However, since the interdigital electrodes for generating the surface acoustic wave are located within the ink material, there are some issues that the electrodes are melted due to interaction generated by the high frequent vibration between the ink material and the electrodes or the ink material adheres on the electrodes. In addition, there is another issue that energy efficiency is relatively low because the leaked Raley waves are easily attenuated during the propagation thereof in the ink material.

In order to solve those issues, a new ink jet recording method utilizing the surface acoustic wave has been proposed in JP-A 2-269058. FIG. 14 is an explanatory view for explaining the principle of a conventional ink jet recording method using surface acoustic wave. In FIG. 14, 41 is a surface of a piezoelectric plate, 42 is an interdigital electrode, 43 is the piezoelectric plate, 44 is ink, 45 is an ink droplet and 46 is a high frequency power supply. The interdigital electrode 42 is formed on the surface of the piezoelectric plate 41. High Frequency electric voltage is applied to the interdigital electrode 42 from the high frequency power supply 46 and ink 44 is placed on a propagating path of the generated surface acoustic wave. When the surface acoustic wave contacts the ink 44, vibration energy leaks into the ink, i.e. generation of the leaked Raley wave, and a portion of the ink is jetted therefrom as an ink droplet 45. In this system, since ink 44 does not directly contact the interdigital electrode 42 and it is not necessary to make the nozzle diameter small, such aforementioned reliability issues in the aforementioned prior methods may be neglected.

However, in this configuration, since the parallel interdigital electrode is utilized, the generated surface acoustic waves tend to propagate in an unintended direction to cause relatively low energy efficiency, crosstalk and unstable jetting direction or unstable diameter of the produced ink droplet compared to the aforementioned other prior art methods. In order to enhance a directivity of the propagation of the surface acoustic wave, the width d of the interdigital electrodes have to be not less than 10 times the wavelength $\lambda$ of the generated surface acoustic wave. In addition, the diameter of the ink droplet is affected directly by the width d of the interdigital electrode, the wavelength $\lambda$ must be much shorter in order to generate a much smaller ink droplet. However, since the shortening of the wavelength directly induces the increasing of the oscillating frequency, an expensive high frequency power supply may be needed; therefore, the oscillating frequency can not be increased so easily.

The disclosures of the following documents also relate to the present invention.

JP-A 62-251153 discloses a surface acoustic wave generator comprising a longitudinal acoustic horn for containing a liquid ink, plural piezoelectric elements that are activated at once to generate standing surface acoustic waves on a free surface of the ink and plural addressing elements for addressing respective wave fronts of the standing surface acoustic wave, wherein both piezoelectric elements and addressing elements are submerged in ink.

JP-A 62-264962 discloses a surface acoustic wave controller for a nozzleless ink droplet ejector comprising an ink pool, plural energy transducers submerged in ink for generating surface acoustic waves each having an energy less than the threshold level sufficient to jet an ink droplet at a certain concentrated point of energy and plural control electrodes located near the concentrated point of energy of a respective wave under a free surface of ink for providing additional energy to jet the ink droplet therefrom.

JP-A 2-172748 discloses a slit-jet printer head comprising a longitudinal ink tank, a first vibrating member located at a side portion of the ink tank for generating meniscuses of the ink due to a generated standing surface wave and a second vibrating member located at a bottom of the ink tank corresponding to each meniscus for providing additional energy to each meniscus to jet an ink droplet therefrom.

JP-A 2-178056 discloses a slit-jet printer head comprising the same features as those of JP-A 2-172748 and further comprising a controller for controlling a frequency applied to ink by the first vibrating means for adjusting relative position between each meniscus and respective second vibrating member.

SUMMARY OF THE INVENTION

The object of the present invention is to provide an ink jet recording device for jetting an ink droplet from a free surface of an ink material, comprising; an ink container for containing the ink material and providing the free surface of the ink material therein, a vibrating member for providing a vibrating energy to the free surface of the ink material by contacting thereto at an interface portion between the free surface of the ink material and the ink container, the vibrating means is surrounding the free surface so that the vibrating energy is concentrated at one specific portion on the free surface of the ink material in order to jet the ink droplet therefrom, and an actuating system for actuating the vibrating member.

DETAILED DESCRIPTION OF PREFERRED EMBODIMENTS

Figure 1:
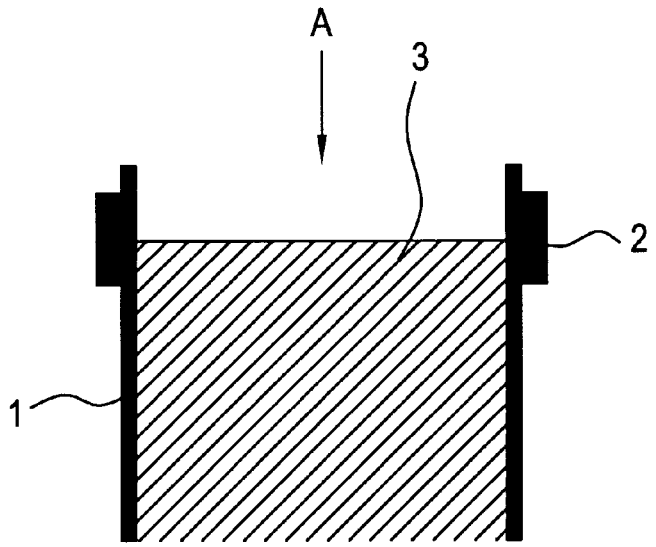
FIG. 1 is a cross-sectional view of the first embodiment of the recording apparatus of the present invention.
Figure 2:
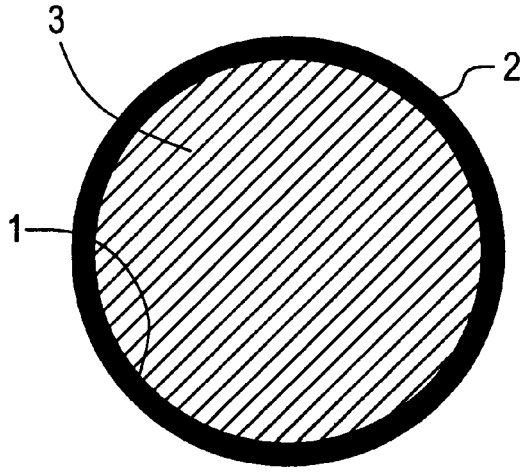
FIG. 2 is a plan view of the first embodiment of the recording apparatus of the present invention.

FIG. 1 is a cross-sectional view of the first embodiment of the recording apparatus of the present invention. FIG. 2 is a plan view of the same. In those FIGS. 1 is a nozzle, 2 is a vibrating member and 3 is ink. FIG. 2 is a view of the same apparatus observed from direction A of FIG. 1. The nozzle 1 is configured as a cylindrical member and ink 3 is provided in the cylindrical member. The vibrating member 2 is mounted near the surface of the ink 3 provided in the nozzle 1.

The vibrating member 2 is constituted by such materials that indicate mechanical strain due to an applied electric field, for example, a piezoelectric element such as barium titanate, lithium niobate, lead titanate zirconate, zinc oxide or the like. The vibrating member 2 is constituted so as to distort in a manner of expanding and shrinking in a direction perpendicular to the outer surface of the nozzle. In this embodiment, a cylindrical-shaped piezoelectric member that is conjugated with the cylindrical nozzle and located in the outer circumference thereof is utilized as the vibrating member 2. However, not limited thereto, a plurality of divided arc-shaped vibrating members may be placed to the circumference of the nozzle 1 entirely or portionally. In addition, the cross-sectional shape of the nozzle may not be a circle; it may be formed as any shape such as an equilateral polygonal shape and positioned so as to concentrate longitudinal waves generated by respective vibrating members to a specific point on the surface of the ink. In this figure, although the vibrating member 2 is located at the outer circumference of the nozzle, the vibrating member 2 may be located at the inner surface of the nozzle contacting the ink or may be the nozzle itself. In those FIGS. although only one portion of the nozzle is disclosed, the nozzle may be connected directly to an ink providing apparatus (not shown) for providing ink 3 to the nozzle or connected thereto via an ink reservoir (not shown) for temporarily reserving the provided ink 3. In addition, the nozzle 1 may have a length longer than a certain length capable of controlling the height of the liquid surface of the ink 3 in the nozzle 1.

Figure 3:
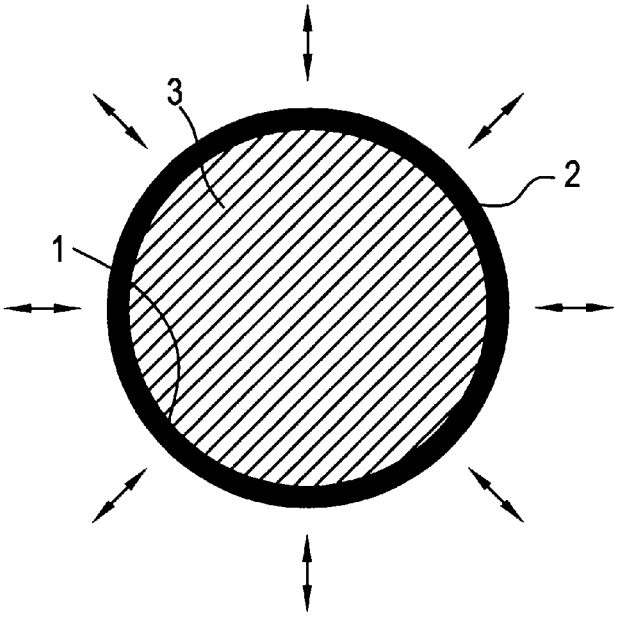
FIG. 3 is a plan view for explaining a principle of the function of the first embodiment of the recording apparatus of the present invention.
Figure 4:
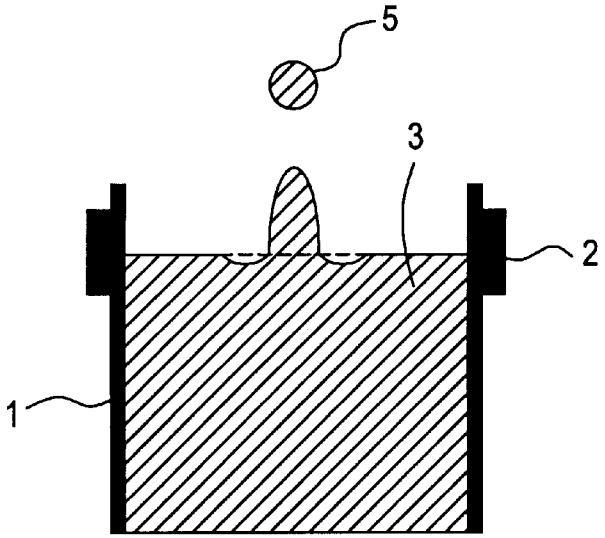
FIG. 4 is a cross-sectional view for explaining a principle of the function of the first embodiment of the recording apparatus of the present invention.

FIG. 3 is a plan view for explaining a principle of the function of the first embodiment of the recording apparatus of the present invention and FIG. 4 is the cross-sectional view of the same. As indicated in FIG. 3, when the vibrating member vibrates along with the perpendicular direction to the circumferential wall of the nozzle by an applied electric field, longitudinal waves directed to the center axis of the cylindrical nozzle are generated beneath the liquid surface of the ink 3. Since longitudinal waves propagate concentrically toward the axis of the nozzle 1 from the inner circumference of the nozzle 1, vibrating energy provided by the circumference of the nozzle is concentrated at the axis of the cylindrical nozzle. Therefore, if a sufficient amount of the vibrating intensity at a certain frequency is applied thereto, an ink droplet 5 is jetted out from the surface of the ink near the axis of the hollow nozzle 1. By adhering the ink droplet to a recording sheet, image recording will be executed.

For example, when vibration of 60 MHz was applied to the vibrating member 2, a droplet having about 50 $\mu$m diameter was generated. In addition, when plural arc-shaped vibrating members are used instead of the cylindrical vibrating member, ink jetting of ink 3 at the axis of the cylindrical nozzle was also performed by harmonizing the phases, i.e.

overlapping of phases with each other, of the generated waves at the axis on the ink surface. Ink 3 is preferably provided in the nozzle so that the surface level of the ink 3 in the nozzle 1 is lower than the uppermost portion of the vibrating member 2 at the ink jetting side.

Figure 5:
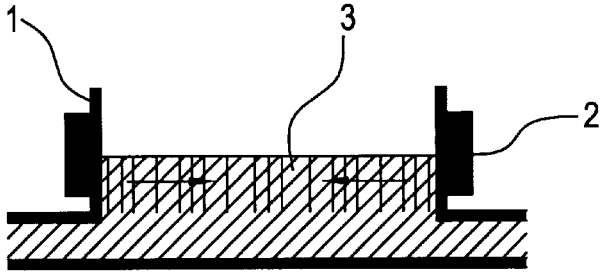
FIG. 5 is an explanatory view of the propagating direction of the longitudinal waves of the recording head of the present invention.
Figure 6:
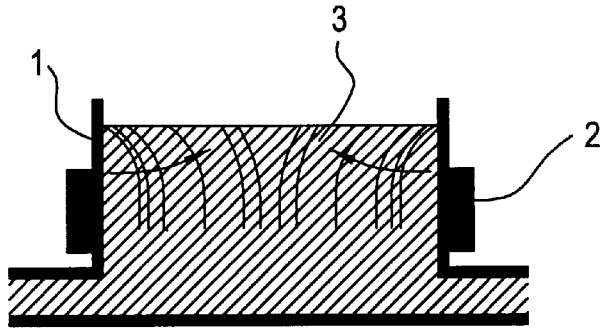
FIG. 6 is an explanatory view of the propagating direction of the longitudinal waves when the vibrating member 2 is placed lower than the liquid surface of the ink.
Figure 7:
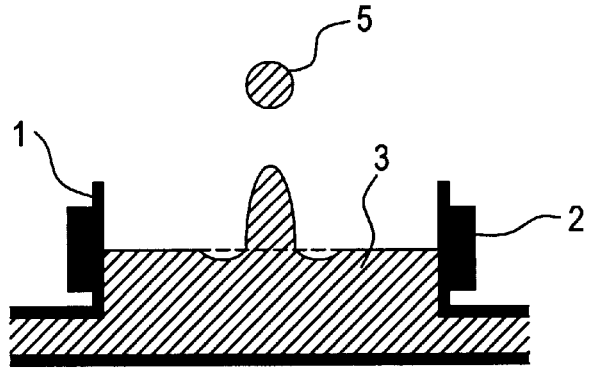
FIG. 7 is another explanatory view of a principle of the function of the recording apparatus of the present invention FIGS. 8(*a*) and (*b*) are explanatory views of a number of wave fronts generated in the second embodiment of the recording head of the present invention.

FIG. 5 is an explanatory view of the propagating phenomenon of the longitudinal waves when the uppermost portion of the vibrating member 2 is higher than the liquid surface of the ink and FIG. 6 is an explanatory view of the propagating phenomenon of the longitudinal waves when the uppermost portion of the vibrating member 2 is lower than the liquid surface of the ink. As indicated in FIG. 5, if the uppermost portion of the vibrating member 2 is higher than the ink surface in terms of ink jetting direction, since generated longitudinal waves propagate toward the axis of the cylindrical nozzle without any unnecessary up and down movement near the ink surface, the vibrating energy is sufficiently concentrated at the axis of the cylindrical nozzle. Thus, as indicated in FIG. 7, an ink droplet 5 is easily jetted therefrom. On the other hand, as indicated in FIG. 6, if the uppermost portion of the vibrating member 2 is lower the liquid surface of the ink 3, since the propagating directions of generated longitudinal waves tend to be bent toward the ink jetting direction near the liquid surface of the liquid ink 3, the vibrating energy is not sufficiently concentrated at the axis of the cylindrical nozzle.

Therefore, by adjusting the liquid surface of the ink 3 so that the uppermost portion of the vibrating means 2 is located higher than the liquid surface in terms of the ink jetting direction, the generated longitudinal waves are stably propagated toward the axis of the cylindrical nozzle near the liquid surface of the ink 3 and vibrating energy generated by the vibrating member 2 is efficiently concentrated at the axis of the cylindrical nozzle near the liquid surface of the ink 3 so as to jet the ink 3.

In addition, since the uppermost portion of the vibrating means 2 is located higher than the liquid surface of ink 3, for example, electrodes or wires of electricity may be easily connected to the uppermost portion of the vibrating member. In such configuration, high reliability of the apparatus is obtained because damage of the electrodes or wires is sufficiently eliminated by avoiding any interference between the ink and electrodes.

The second embodiment of the present invention is explained hereinafter. The configuration of the second embodiment of the recording apparatus is similar to those of the aforementioned embodiment 1 as disclosed in FIGS. 1 and 2 except that the vibrating member 2 vibrates along with the axis of the nozzle 1.

Figure 8A:
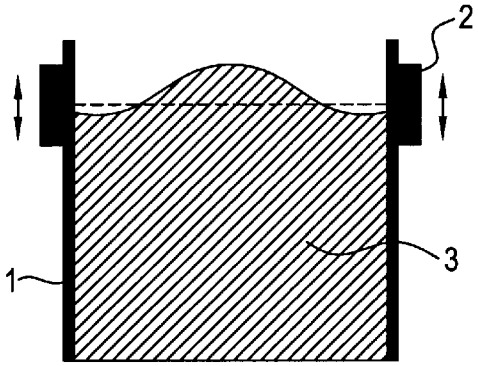
Figure 8B:
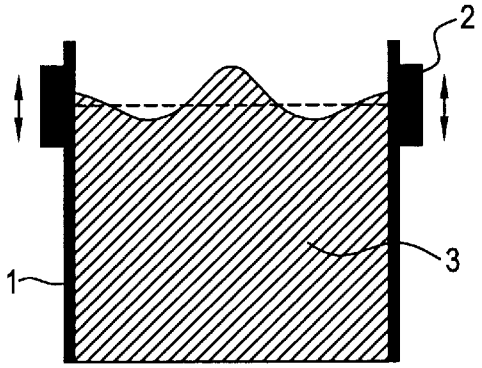
Figure 9A:
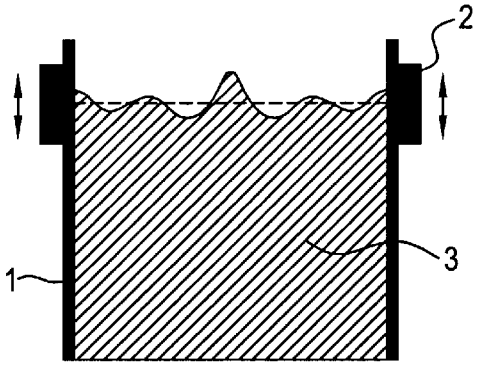
FIGS. 9 (*a*) through (*d*) are explanatory views of amplitude of waves generated in the second embodiment of the recording head of the present invention.
Figure 9B:
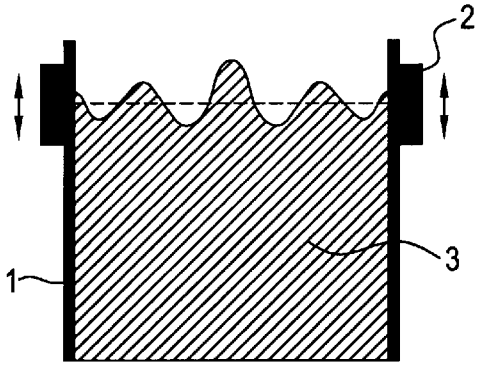
Figure 9C:
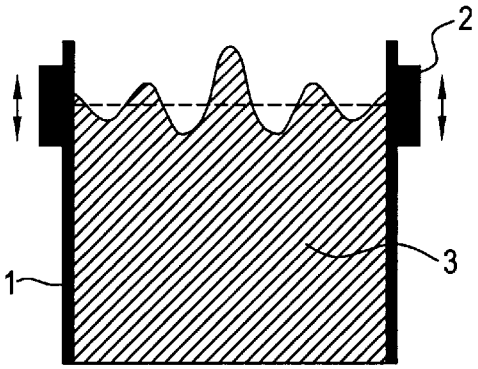
Figure 9D:
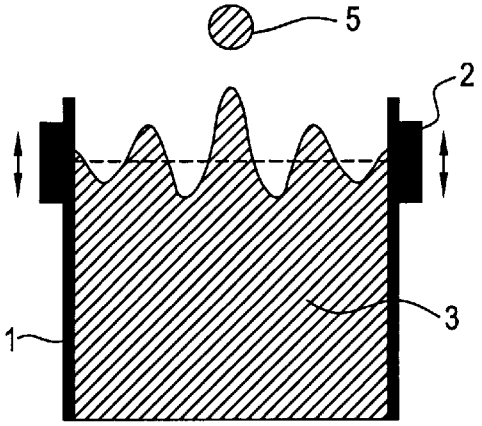

FIGS. 8 (*a*), (*b*) and FIGS. 9 (*a*) through (*d*) are cross-sectional views of the second embodiment of the recording apparatus of the present invention for explaining the principle of the function. When the vibrating member 2 vibrates along with the axis of the nozzle at a specific frequency, a standing wave having one wave length is generated as indicated in FIG. 8(*a*). As the frequency of the vibrating means 2 increases, a standing wave having two wavelength is generated at a specific frequency as indicated in FIG. 8(*b*). Similarly, as the frequency of the of the vibrating means 2 increases, a standing wave having n wavelength (n is an integer) is generated at a specific frequency. On the other hand, as vibrating intensity (i.e. amplitude) of the cylindrical vibrating means increases, the amplitude of the standing wave increases as indicated in FIG. 9 (*a*), (*b*) and (*c*) and when the vibrating intensity reaches a specific intensity, a crest, located in the axis of the cylindrical nozzle, which has the most significant amplitude in the wave comes off to be a small droplet 5 as indicated in FIG. 9(*d*). By adhering the droplet onto a recording sheet, an image recording will be performed.

As a specific example, an experiment was performed by using a cylindrical nozzle that has a 200 $\mu$m diameter, a cylindrical vibrating member 2 positioned near the tip of the nozzle and ink having a surface tension of 0.040N/m and a density of 1050 kg/m$^3$ located in the nozzle. The frequency of the standing wave that is generated therein is estimated by the following principle. Since the waves propagate on the ink surface and are generated within the nozzle, the subjecting wavelength in the following equations is not more than 200 $\mu$m.

The propagation of the wave is generally subjected to the surface tension of the liquid, i.e. propagating medium. Therefore, the propagation velocity v of the capillary wave (the transverse wave) is defined by the following equation:

$$v=(2\pi\sigma/\rho\lambda)^{1/2} \tag{1}$$

wherein $\sigma$ is the surface tension of the liquid (mN/m), $\rho$ is the density of the liquid (g/cm$^3$) and $\lambda$ is the wavelength (nm).

On the other hand, the frequency of the wave fk is defined by the propagation velocity and the wavelength as follows:

$$fk=v/\lambda \tag{2}$$

Then, the following equation is obtained from the equations (1) and (2):

$$\lambda=\{2\pi\sigma/(\rho fk^2)\}^{1/3} \tag{3}$$

On the other hand, the fk is defined as follows:

$$fk=fe/2 \tag{4}$$

wherein fe is the oscillating frequency (Hz).

Then, the following equation is obtained from the equations (3) and (4)

$$\lambda=\{8\pi\sigma/(\rho fe^2)\}^{1/3} \tag{5}$$

Finally, fe is defined by the following equation:

$$fe=(8\pi\sigma/\rho)^{1/2}\lambda^{-3/2} \tag{6}$$

When ink having 0.040N/m of $\sigma$, 1050 Kg/m$^3$ of $\rho$ is used as the aforementioned example, fe is calculated as follows by incorporating those actual values into the equation (6):

$$\mathrm{fe}=0.031\ \lambda^{-3/2} \tag{7}$$

On the other hand, the wavelength generated in the cylindrical nozzle is provided by the following equation when D is the diameter of the hollow nozzle:

$$\lambda=D/n \tag{8}$$

wherein, n is the wave number (an integer) generated in the cylindrical nozzle.

Thus, the value fe is obtained based on equations (7) and (8) as follows:

$$fe=0.031(D/n)^{-3/2} \tag{9}$$

In the above actual example, since the nozzle diameter D is 200 $\mu$m, fe is obtained as:

$$\mathrm{fe}=10960\mathrm{n}^{3/2} \tag{10}$$

Figure 10:
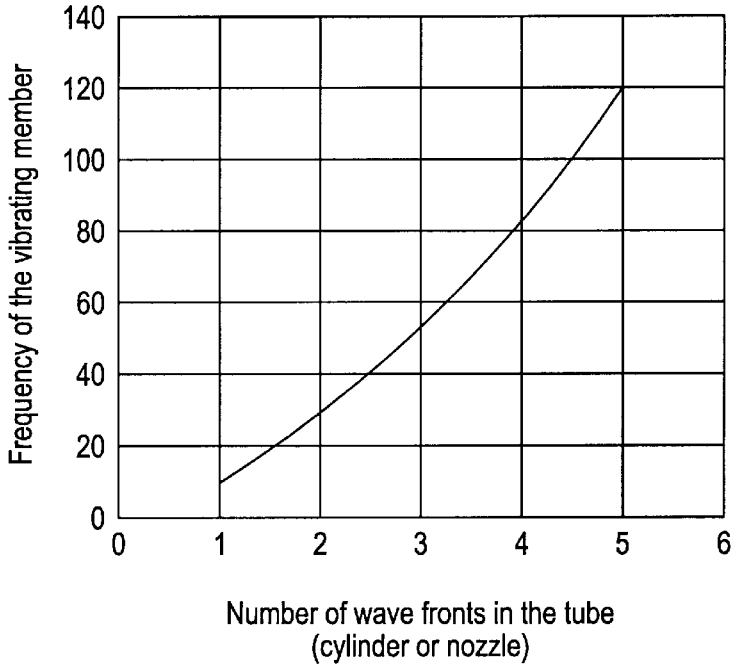
FIG. 10 is a graph showing a relationship between the wave number generated in the nozzle and the applied frequency thereto in the second embodiment of the recording apparatus of the present invention.

FIG. 10 is a graph showing a relationship between the wave number generated in the nozzle and the applied frequency thereto in the second embodiment of the recording apparatus of the present invention. As mentioned above, when a vibration is applied to the nozzle having 200 $\mu$m diameter and containing an ink having 0.040N/m of $\sigma$ and 1050 Kg/m$^3$of $\rho$, the relationship between the wave number generated in the nozzle and the applied frequency is obtained as FIG. 10. For example, the wave number of the generated wave in the nozzle when the vibration having 88 KHz frequency is applied thereto by the vibrating member 2 is determined to be four from the graph. In other words, as indicated in FIG. 9, it is possible to generate a four-time wavelength of standing wave having 50 $\mu$m of wavelength in the nozzle by applying vibration having 88 KHz frequency thereto by the vibrating means 2. Then, when the voltage applied to the vibrating means is reached to a specific value, as indicated in FIG. 9 (*d*), jetting of the ink droplet begins from the center portion, i.e. axis, of the cylindrical nozzle. In this specific example, the diameter of the ink droplet was about 20 $\mu$m.

The vibrating member 2 may also be constituted by plural separated vibrating means in the second embodiment. In this case, it is possible to jet an ink droplet form the center portion of the nozzle by overlapping phases of respective waves generated by the plural vibrating means.

Figure 11A:
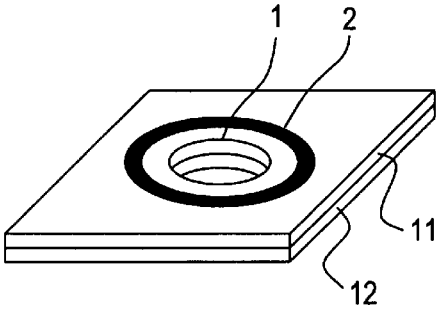
FIGS. 11(*a*) and (*b*) are explanatory views of the alternative example of the second embodiment of the recording apparatus of the present invention.
Figure 11B:
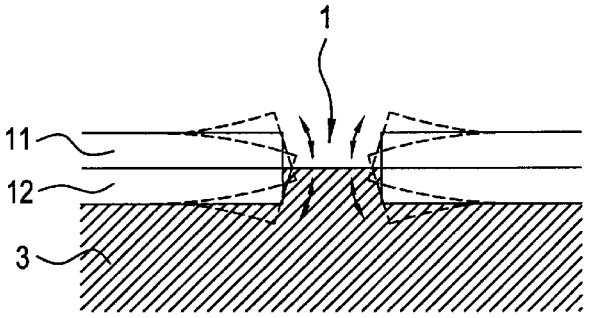

Although ink 3 was vibrated indirectly by the vibrating member 2 in the second embodiment, it is not limited thereto. Ink 3 may also be vibrated directly through the nozzle. FIG. 11(*a*) and (*b*) are an explanatory views of the alternative example of the second embodiment of the recording apparatus of the present invention. In this Figure, both of 11 and 12 are plates. In this example, two plates, each of which has a unique characteristic, are bonded to each other facing each plane surface and those plates are defining an opening as a nozzle 1. The bottom surface of the plate 12 may serve as one of the walls of ink reservoir and ink is filled up to the nozzle 1.

In this configuration, it is possible to move the edge of the nozzle 1 upwardly and downwardly by expanding or shrinking at least one of those two plates near the edge for causing a bending thereof. This functional principle is the same with that of the heated bimetal that is produced by bonding two metal plates each of which has a unique coefficient of thermal expansion. It is possible to provide a vibration to ink 3 by repeating such movements. The vibrating member may be constituted according to physical characteristics of those plates 11 and 12. For example, if piezoelectric elements are utilized as those plates, the vibrating member 2 may be electrically coupled to a power supply for supplying an electric signal to those plates. Otherwise, if those plates 11 and 12 are constituted by bimetal plates or shaped memory alloy and rapid bending and recovering movement are possible, the vibrating member 2 may be thermally coupled to a heating element.

Figure 12A:
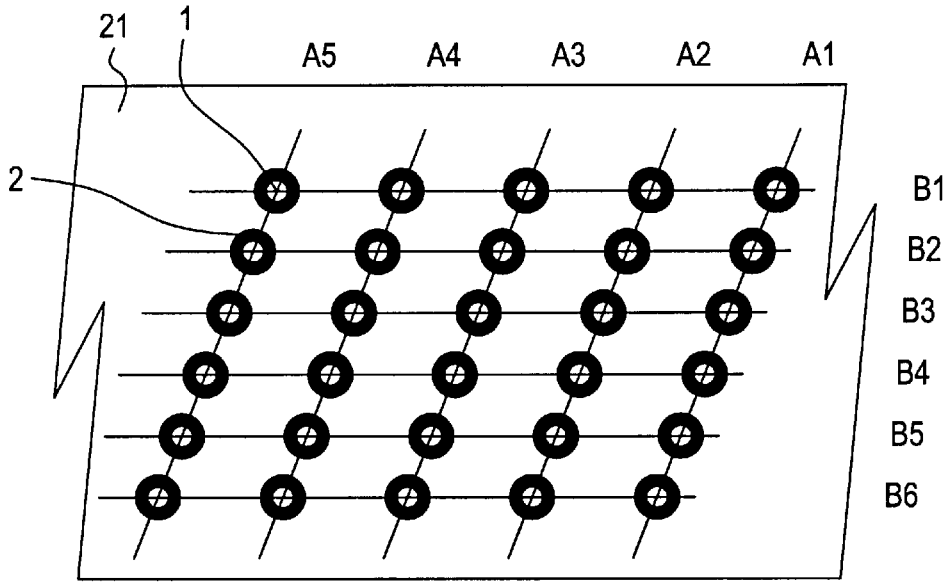
FIGS. 12 (*a*) and (*b*) are explanatory views of the third embodiment of the recording apparatus of the present invention, which has plural nozzles.
Figure 12B:
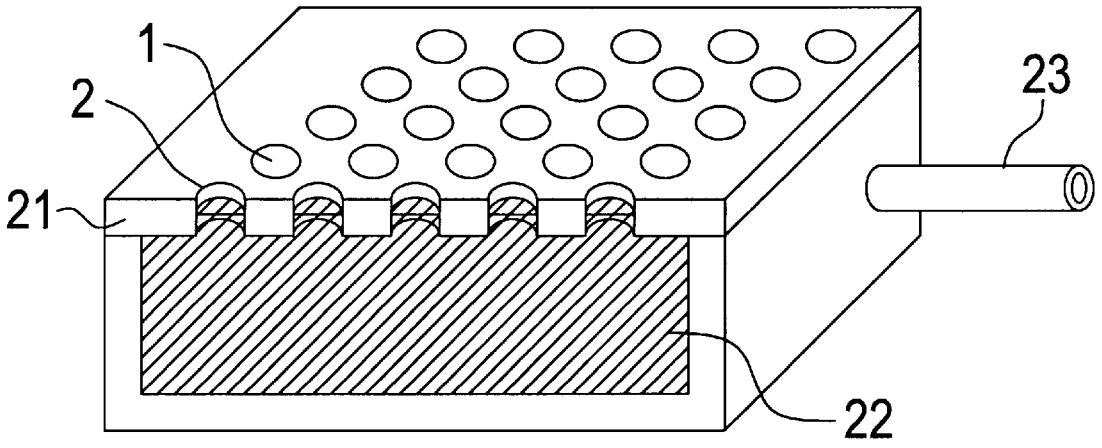

FIGS. 12(*a*) and (*b*) are explanatory views of the third embodiment of the recording apparatus of the present invention, which has plural nozzles. In those FIGS. 21 is a plate, 22 is an ink reservoir and 23 is an ink transporting tube. The aforementioned nozzles in the first and second embodiment may be arranged in a row or in a line as a series of nozzles. The third embodiment of the present invention, as shown in FIGS. 12(*a*) and (*b*), is an example that nozzles disclosed in the first and second embodiment are arranged for forming a matrix of nozzles.

Plural openings as respective nozzles are defined by the plate 21 for forming a matrix. The openings are, for example, formed by laser beam machining. $CO_2$ laser beam machining having a high throughput characteristic is preferably used when cost performance of the processing is highly considered, otherwise, Excimer laser beam machining is preferably used when prevention of heat damage or cracking of the plate are highly considered. In addition, drill processing or punching processing may also be used when the cost performance of the processing is considered much higher.

The nozzles are arranged linearly in a row direction and are arranged so as not to place another nozzle in a perpendicular direction to the row direction by shifting respective nozzle slightly with respect to each other in a column direction. It is possible to perform much higher density recording by relatively moving such configured recording head and a recording sheet in an up and down direction in this drawing compared to a normal recording head where plural nozzles are arranged along with rectangularly crossed lines.

Each nozzle 1 has respective vibrating member 2. Lengthwise lead lines A1 to A5 and breadthwise lead lines B1 to B6 are connected to respective vibrating members 2 in order to supply electric energy thereto as shown in FIG. 12 (*a*). In this embodiment, by choosing both of at least one of lead lines A1 to A5 and at least one of lead lines B1 to B6 and applying electric energy thereto, a specific vibrating member 2 corresponding to the selected nozzle 1 is selectively addressed and actuated to vibrate the nozzle. It is possible to perform image recording onto a recording sheet by controlling the addressing and actuating timing and relative movement of the head against the recording sheet corresponding to an image signal. Although, FIG. 12(*a*) is described only as a schematic view, practically, lead lines A1 to A5 and lead lines B1 to B6 are respectively connected to both electrodes of each vibrating member 2 located at each cross-section.

Each nozzle 1 should be refilled with a certain amount of ink material, which is equivalent to the jetted ink, after ink-jetting operation for preparing the subsequent ink-jetting operation. Therefore, in this embodiment, as shown in FIG. 12 (*b*), an ink reservoir 22 is arranged beneath the plate 21 for reserving the ink material. Ink is provided from an ink tank (not shown) through the ink providing tube 23. Thus, levels of the liquid surface of the ink in respective nozzles 1 are normally maintained constant and the distance between the ink surface and the recording sheet is also maintained constant so as to maintain a size of recording dots and perform high quality recording.

Although the ink reservoir 22 is formed as a relatively shallow container beneath the plate 21 similar to that of the embodiment 1 in FIG. 7, an ink tank having a relatively deep container may be formed beneath the plate 21. In this case, the configuration is similar to a modified version of the second embodiment, which has a relatively deep ink tank depth. Certainly, the ink reservoir 22 just beneath the nozzles 1 may be formed as a relatively deep container and nozzles described in the embodiment 2 may be arranged in a matrix form. Otherwise, the ink reservoir may be formed as much shallower providing a relatively deep ink reserving portion between those nozzles and the ink providing tube 23. In this case, the ink reservoir 22 may be constituted so that ink is provided from an ink providing tube 23 to the ink reservoir 22 through the deep portion under certain pressure.

Although the matrix arrangement of the nozzles are described above, it is not limited thereto. One-line arrangement of nozzles is also practical. In addition, although each nozzle is configured as cylindrical shape, for example, plural nozzles may be configured as a part of one common slit and circular-arc vibrating member(s) may be arranged on at least one of the longitudinal edge portions of the slit so as to jet an ink droplet from a hypothetical center portion of the circle constituted by the vibrating means.

Figure 13:
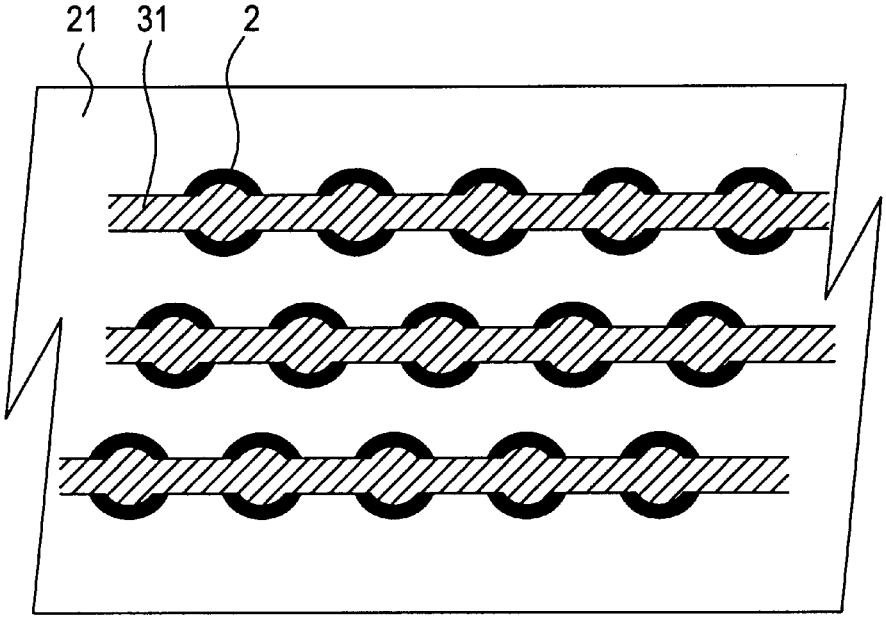
FIG. 13 is a plan view of an alternative example of the third embodiment of the present invention where the plural nozzles are configured by a longitudinal slit.
Figure 14:
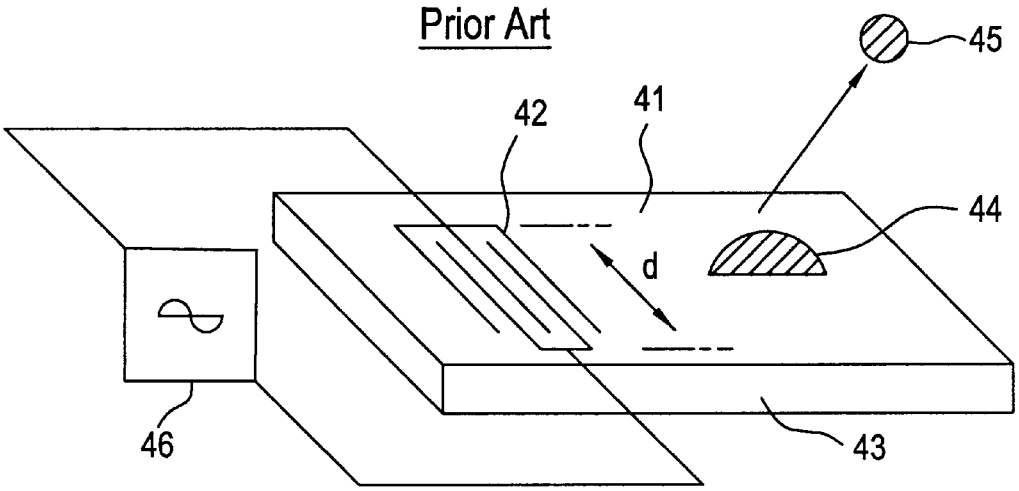
Fig. 14 Prior Art
FIG. 14 is an explanatory view of the prior ink jet recording method utilizing surface acoustic waves.

FIG. 13 is a plan view wherein plural nozzles are configured by a slit. Plural pairs of circular-arc vibrating members are arranged along both longitudinal side edges of the slit corresponding to each nozzle portion. The ink droplet is produced and jetted from the center portion by arranging hypothetical axes of the pair of circular-arc vibrating members cocentrical. However, as mentioned before, the circular-arc vibrating members may be arranged only to one side edge of the slit. Although matrix arrangement of nozzles are shown in FIG. 12 and 13, the nozzles may also be configured as a one-line arrangement.

According to the present invention, as mentioned above, since vibrating energy is applied near the ink surface and vibrating energy is propagated and concentrated thereon, relatively high energy efficiency is obtained. In addition, since the vibrating energy is concentrated at a point, small ink droplets are accurately jetted toward the perpendicular direction to the ink surface.

What is claimed is:

1. An ink jet recording device for jetting an ink droplet from a free surface of an ink material, comprising:

an ink container for containing an ink material and providing a free surface of the ink material therein;

a vibrating member which provides a vibrating energy to the free surface of the ink material, wherein the vibrating member is in contact with the ink material at an interface portion between the free surface of the ink material and the ink container, and wherein the vibrating member surrounds the free surface so that the vibrating energy is concentrated at only one specific point on the free surface of the ink material in order to jet the ink droplet from the surface of the ink material; and an actuating system for actuating the vibrating member.

2. An ink jet recording device as set forth in claim 1, wherein the vibrating member provides the vibrating energy to the free surface of the ink material in the form of longitudinal wave.

3. An ink jet recording device as set forth in claim 2, wherein the vibrating member vibrates in a direction parallel to the free surface of the ink material.

4. An ink jet recording device as set forth in claim 3, wherein the vibrating member is a part of the ink container.

5. An ink jet recording device as set forth in claim 1, wherein the vibrating member provides the vibrating energy to the free surface of the ink material in the form of a surface acoustic wave.

6. An ink jet recording device as set forth in claim 1, wherein the vibrating member vibrates in a direction perpendicular to the free surface of the ink material.

7. An ink jet recording device as set forth in claim 1, wherein the ink container comprises a nozzle.

8. An ink jet recording device as set forth in claim 1, wherein the vibrating member is positioned so that a part of the vibrating member is exposed to air when the ink material is filled into the ink container.

9. An ink jet recording device as set forth in claim 1, wherein the vibrating member comprises a plurality of vibrating elements arranged in a symmetrical manner.

10. An ink jet recording apparatus including a series of plural ink jet recording devices as set forth in claim 1.

11. An ink jet recording apparatus as set forth in claim 10, wherein a series of the ink jet recording devices are arranged linearly in a first direction and arranged alternatively in a second direction and the actuating system is constituted by plural electric lines crossing in both of the first direction and the second direction, and wherein said electric lines are connected to each of the vibrating members.

12. An ink jet recording apparatus as set forth in claim 10, wherein each of the vibrating members comprises a piezoelectric element.

13. An ink jet recording apparatus for jetting an ink droplet from a free surface of an ink material, comprising:

an ink container containing an ink material;

a slit providing a free surface of the ink material linearly;

a plurality of round-shaped ink jetting nozzles; and a plurality of vibrating members which provide a vibrating energy to the free surface of the ink material wherein the vibrating members define said plurality of round-shaped ink jetting nozzles, and wherein the vibrating members contact the ink material, wherein the vibrating members are arranged so that the vibrating energy is concentrated at only one specific point on the free surface of the ink material at a central area of each of said nozzles in order to jet the ink droplet from the free surface of the ink material; and an actuating system for actuating the vibrating members.

14. An ink jet recording apparatus as set forth in claim 13, wherein each vibrating member comprises a plurality of vibrating elements arranged symmetrically around the nozzle.

15. An ink jet recording apparatus as set forth in claim 13, wherein each vibrating member comprises a piezoelectric element.

16. An ink jet recording method for jetting an ink droplet from a free surface of an ink material, comprising:

providing an ink material with a free surface; and applying a vibrating energy surroundingly to the free surface of the ink material by contacting the vibrating energy to the free surface of the ink material so that the vibrating energy is concentrated at only one specific point on the free surface of the ink material in order to jet the ink droplet from the free surface of the ink material.

17. An ink jet recording method as set forth in claim 16, wherein the vibrating energy is applied in the form of longitudinal wave.

18. An ink jet recording method as set forth in claim 16, wherein the vibrating energy is applied in the form of surface acoustic wave.

* * * * *